US012480669B2

(12) United States Patent
Wolff

(10) Patent No.: US 12,480,669 B2
(45) Date of Patent: Nov. 25, 2025

(54) WALL MOUNTED BYPASS HUMIDIFIER

(71) Applicant: RESIDEO LLC, Golden Valley, MN (US)

(72) Inventor: Steven L Wolff, Hamel, MN (US)

(73) Assignee: RESIDEO LLC, Golden Valley, MN (US)

( * ) Notice: Subject to any disclaimer, the term of this patent is extended or adjusted under 35 U.S.C. 154(b) by 7 days.

(21) Appl. No.: 16/824,393

(22) Filed: Mar. 19, 2020

(65) Prior Publication Data

US 2021/0293420 A1 Sep. 23, 2021

(51) Int. Cl.

| | |
|---|---|
| ***F24F 3/14*** | (2006.01) |
| ***F24F 13/02*** | (2006.01) |
| ***F24F 13/20*** | (2006.01) |
| ***F24F 13/22*** | (2006.01) |

(52) U.S. Cl.

CPC ..... *F24F 3/14* (2013.01); *F24F 13/0209* (2013.01); *F24F 13/20* (2013.01); *F24F 13/222* (2013.01)

(58) Field of Classification Search

CPC ..... F24F 3/14; F24F 13/0209; F24F 13/20; F24F 13/222; F24F 13/0236; F24F 6/02; F24F 6/04; Y10S 261/15; F25C 1/243; F25C 1/04; F25C 1/10; F25C 5/00; F25C 5/08; F25C 5/22; F25C 2500/02; F25C 2600/04; F25C 1/18; F25C 1/24; F25C 1/06; F25D 11/02; F25D 17/062; F25D 17/045; F25D 23/12

USPC ..... 236/44 A

See application file for complete search history.

(56) References Cited

U.S. PATENT DOCUMENTS

| | | | | | |
|---|---|---|---|---|---|
| 2,237,497 | A * | 4/1941 | Munford | B60H 1/00471 | 261/DIG. 4 |
| 2,259,541 | A * | 10/1941 | Ballard | F28D 5/00 | 62/316 |
| 2,270,810 | A * | 1/1942 | Larriva | F25B 39/04 | 165/184 |
| 2,323,511 | A * | 7/1943 | Carroll | F28D 7/16 | 62/305 |
| 3,012,416 | A * | 12/1961 | Dart | F28B 1/06 | 261/109 |
| 3,105,860 | A * | 10/1963 | Dunn | F24F 6/04 | 261/103 |
| 3,119,887 | A * | 1/1964 | Baehr | F24D 5/00 | 261/36.1 |
| 3,136,829 | A * | 6/1964 | Skerritt | F24F 6/04 | 261/DIG. 15 |

(Continued)

FOREIGN PATENT DOCUMENTS

| | | | | |
|---|---|---|---|---|
| CA | 2996347 A1 * | 3/2011 | ..... | F24F 11/30 |
| GB | 2326938 A * | 1/1999 | ..... | F24F 1/037 |

*Primary Examiner* — Eric S Ruppert
*Assistant Examiner* — Kirstin U Oswald
(74) *Attorney, Agent, or Firm* — Greenberg Traurig, LLP; Ryan D. Sharp; David J. Dykeman

(57) ABSTRACT

In some examples, a device is configured to add moisture to an air stream of a heating, ventilation and air conditioning (HVAC) system configured to regulate one or more parameters of a space within a building. The device includes a housing that defines at least part of an air path, where the air path is configured to carry the moisture to the air stream of the HVAC system, where the housing includes a bottom housing formed as a single unit and a top housing configured to be attached to the bottom housing.

21 Claims, 7 Drawing Sheets

(56) References Cited

U.S. PATENT DOCUMENTS 3,148,516 A * 9/1964 Kals ..... F28B 1/02 165/113
3,171,401 A * 3/1965 Mcduffee ..... F24F 6/04 261/DIG. 15
3,211,380 A * 10/1965 Skerritt ..... F24D 5/00 261/106
3,307,835 A * 3/1967 Perlman ..... F24F 6/04 261/96
3,497,453 A * 2/1970 Yurdin ..... F24F 6/04 210/698
3,659,352 A * 5/1972 Cook ..... F26B 9/06 34/191
3,740,959 A * 6/1973 Foss ..... F24F 5/0042 261/80
3,770,254 A * 11/1973 Morrow ..... F24F 3/14 261/DIG. 15
3,867,486 A * 2/1975 Nagele ..... F24F 6/04 261/106
3,984,995 A * 10/1976 Starr ..... F25D 7/00 62/305
4,069,030 A * 1/1978 Nickell ..... F24F 11/00 165/251
4,090,370 A * 5/1978 Vaughan ..... F24F 6/04 236/44 C
4,182,131 A * 1/1980 Marshall ..... F25B 39/04 62/305
4,380,910 A * 4/1983 Hood ..... F24F 1/0087 62/304
4,439,375 A * 3/1984 Koble, Jr. ..... F24F 6/04 261/106
4,612,778 A * 9/1986 Medrano ..... F24F 6/04 62/304
5,121,770 A * 6/1992 Thompson ..... F24F 5/0035 261/DIG. 46
5,349,829 A * 9/1994 Tsimerman ..... F24F 5/0035 261/153
5,435,382 A * 7/1995 Carter ..... F28D 5/02 261/153
6,142,219 A * 11/2000 Korenic ..... F28C 1/14 261/153
6,367,277 B1 * 4/2002 Kinkel ..... F28D 5/00 62/310
6,572,085 B2 6/2003 Bloemer
8,444,118 B1 * 5/2013 Dumler ..... F28F 27/003 261/DIG. 11
2006/0086814 A1 4/2006 Helt et al.
2007/0151278 A1 * 7/2007 Jarvis ..... F24F 1/0007 62/310
2008/0079177 A1 4/2008 Schuld
2009/0032981 A1 * 2/2009 Graef ..... F28F 25/087 427/256
2011/0068491 A1 * 3/2011 Wang ..... F24F 6/04 261/103
2011/0100593 A1 * 5/2011 Benz ..... F28D 1/0477 165/59
2012/0006038 A1 * 1/2012 Sharma ..... H05K 7/20745 62/97
2013/0186611 A1 * 7/2013 Schneider ..... F24F 6/043 236/44 A
2014/0116657 A1 * 5/2014 Ritchie ..... F24F 5/0035 165/120
2014/0283450 A1 * 9/2014 Darlington ..... A01G 31/02 47/62 A
2015/0068962 A1 * 3/2015 Kim ..... F28C 1/02 261/28
2015/0204626 A1 * 7/2015 Martell ..... F28C 1/14 165/200
2017/0082370 A1 * 3/2017 Strumenti ..... F28C 3/08
2018/0094825 A1 4/2018 Peczalski et al.

* cited by examiner

WALL MOUNTED BYPASS HUMIDIFIER

TECHNICAL FIELD

The disclosure relates to humidifiers for adding humidity to an inside space of a building structure.

BACKGROUND

In dry or cold climates, it may be useful to add moisture to the air inside enclosed spaces to maintain humidity levels. There are many products on the market employing a variety of techniques to increase such humidity levels. An example product includes evaporative humidifiers, designed to add moisture to the air of a heating, ventilation, and air conditioning (HVAC) system.

Some example evaporative humidifiers include a bypass evaporative humidifier. A bypass evaporative humidifier directs air from an air stream of the HVAC system, through a moistened humidifier pad, and back into an air stream of the HVAC system. Such humidifiers often include a housing mounted to the outside of an air duct, plenum, or the like of the HVAC system. The housing may include an internal cavity that houses the humidifier pad, an air inlet that directs an incoming air stream from the HVAC system to the humidifier pad, and an air outlet that directs a moistened air stream from the humidifier pad and into an air stream of the HVAC system.

Other example evaporative humidifiers include a fan-assisted humidifier. A fan-assisted humidifier uses a powered fan or blower to help force air from an air inlet to the air outlet and through the humidifier. In other humidifiers, a pressure differential created by the main circulating fan or blower of the HVAC system between the return air duct and the supply air duct is used to draw air from the supply air duct, through the humidifier pad of the humidifier, and to the return duct of the HVAC system.

SUMMARY

In general, the disclosure is directed to a humidifier including a top humidifier housing and a bottom humidifier housing configured to hold an evaporative pad. More specifically, the humidifier may be configured to add moisture to an air stream of a heating, ventilation and air conditioning (HVAC) system such as, for example, adding moisture to an air stream within a duct or network of ducts. In some examples, the humidifier includes a water source which supplies water to a top end of the evaporative pad. The evaporative pad may evaporate the water supplied by the water source as the water flows from the top end of the evaporative pad to a bottom end of the evaporative pad, and the humidifier may deliver the evaporated water to the air stream of the HVAC system in order to add moisture to the air stream. In some cases, the evaporative pad might not evaporate all of the water delivered by the water source to the humidifier. In at least some such cases, the bottom housing of the HVAC system may include a drain configured to evacuate the non-evaporated water from the humidifier without leakage.

In some examples, humidifier includes an air path which flows through the humidifier from an input port to an output port. In some examples, the input port and the output port represent stadium-shaped apertures which are configured to connect to one or more flanges which in turn connect to the HVAC system. It may be beneficial for the input port and the output port to be stadium-shaped in order to decrease a width of the humidifier as compared with humidifiers with input ports and output ports that are not stadium-shaped (e.g., square circular, or rectangular). For example, the input port and the output port may be located on a top end of the top housing of the humidifier. In this way, a width of the input port and a width of the input port may affect a width of the humidifier as a whole. Stadium-shaped ports may allow the humidifier to have large ports by surface area while maintaining a beneficial width.

In some examples, a device is configured to add moisture to an air stream of an HVAC system configured to regulate one or more parameters of a space within a building. The device includes a housing that defines at least part of an air path, where the air path is configured to carry the moisture to the air stream of the HVAC system, where the housing includes a bottom housing formed as a single unit. The bottom housing includes evaporative pad support rails configured to hold an evaporative pad in a fixed position such that the evaporative pad divides the bottom housing into an intake section and a discharge section, where the air path is constrained to direct air flow to the discharge section from the intake section and through the evaporative pad. Additionally, the housing includes a top housing configured to be attached to the bottom housing, where the top housing includes an intake flange defining an intake port, where the intake port is configured to mechanically connect to a first air duct, receive a portion of the air stream from the first air duct, and direct the portion of the air stream to the air path via the intake section of the bottom housing. Additionally, the housing includes a discharge flange defining a discharge port, where the discharge port is configured to mechanically connect to a second air duct, receive the portion of the air stream from the evaporative pad, and direct the portion of the air stream to the second air duct. Additionally, the system includes a water distributor support configured to position a water distributor above the evaporative pad.

In some examples, a method for adding moisture to an air stream of an HVAC system configured to regulate one or more parameters of a space within a building. The method includes carrying, by an air path defined by a housing of a device, moisture to an air stream of the HVAC system; holding, by a bottom housing of the housing of the device, an evaporative pad in a fixed position such that the evaporative pad divides the bottom housing into an intake section and a discharge section, where the air path is constrained to direct air flow to the discharge section from the intake section and through the evaporative pad, and where the bottom housing is formed as a single unit; attaching a top housing to the bottom housing; receiving a portion of the air stream from a first air duct by an intake port defined by an intake flange, where the intake port is configured to mechanically connect to the first air duct; directing the portion of the air stream to the air path via the intake section of the bottom housing; receiving the portion of the air stream from the evaporative pad by a discharge port defined by a discharge flange, where the discharge port is configured to mechanically connect to a second air duct; and directing the portion of the air stream to the second air duct, where the device includes a water distributor support configured to position a water distributor above the evaporative pad.

In some examples, a system is configured to add moisture to an air stream of an HVAC system configured to regulate one or more parameters of a space within a building. The system includes an evaporative pad; a housing that defines at least part of an air path, where the air path is configured to carry the moisture to the air stream of the HVAC system, where the housing includes a bottom housing formed as a single unit, where the bottom housing includes evaporative pad support rails configured to hold the evaporative pad in a fixed position such that the evaporative pad divides the bottom housing into an intake section and a discharge section, where the air path is constrained to direct air flow to the discharge section from the intake section and through the evaporative pad. Additionally the housing includes a top housing configured to be attached to the bottom housing, where the top housing includes an intake flange defining an intake port, where the intake port is configured to: mechanically connect to a first air duct; receive a portion of the air stream from the first air duct; and direct the portion of the air stream to the air path via the intake section of the bottom housing. Additionally, the housing includes a discharge flange defining a discharge port, where the discharge port is configured to: mechanically connect to a second air duct; receive the portion of the air stream from the evaporative pad; and direct the portion of the air stream to the second air duct. Additionally, the system includes a water distributor support configured to position a water distributor above the evaporative pad.

The summary is intended to provide an overview of the subject matter described in this disclosure. It is not intended to provide an exclusive or exhaustive explanation of the systems, device, and methods described in detail within the accompanying drawings and description below. Further details of one or more examples of this disclosure are set forth in the accompanying drawings and in the description below. Other features, objects, and advantages will be apparent from the description and drawings, and from the claims.

DETAILED DESCRIPTION

This disclosure is directed to an evaporative humidifier including a humidifier housing configured to hold a humidifier pad. Evaporative humidifiers, in contrast to steam or other types of humidifiers, may direct air from an air stream of heating, ventilation and air conditioning (HVAC) system through a moistened humidifier pad. The humidifier pad may be replaceable. Air passing through the pad picks up moisture by evaporating water applied to the pad. The water may be applied by a water distributor on top of the pad. Humidifiers may be designed to supply a specific amount of moisture to the air and sized to accommodate the capacity of a HVAC system to which the humidifier would be attached. Accordingly, the replaceable humidifier pad may be sized for the designed capacity of the HVAC system. Additionally, the housing may be designed to drain water applied by the water distributor which is not evaporated by the evaporative pad. The housing may be connected to an output flange and an input flange. In some examples, the output flange of the humidifier may be connected to an inlet side of a distribution blower of the HVAC system. In the example of a bypass humidifier, the lower pressure of the inlet side of the distribution blower compared to the pressure in the supply duct provides a suction to help draw air from the humidifier air path into the HVAC system air stream.

Figure 1:
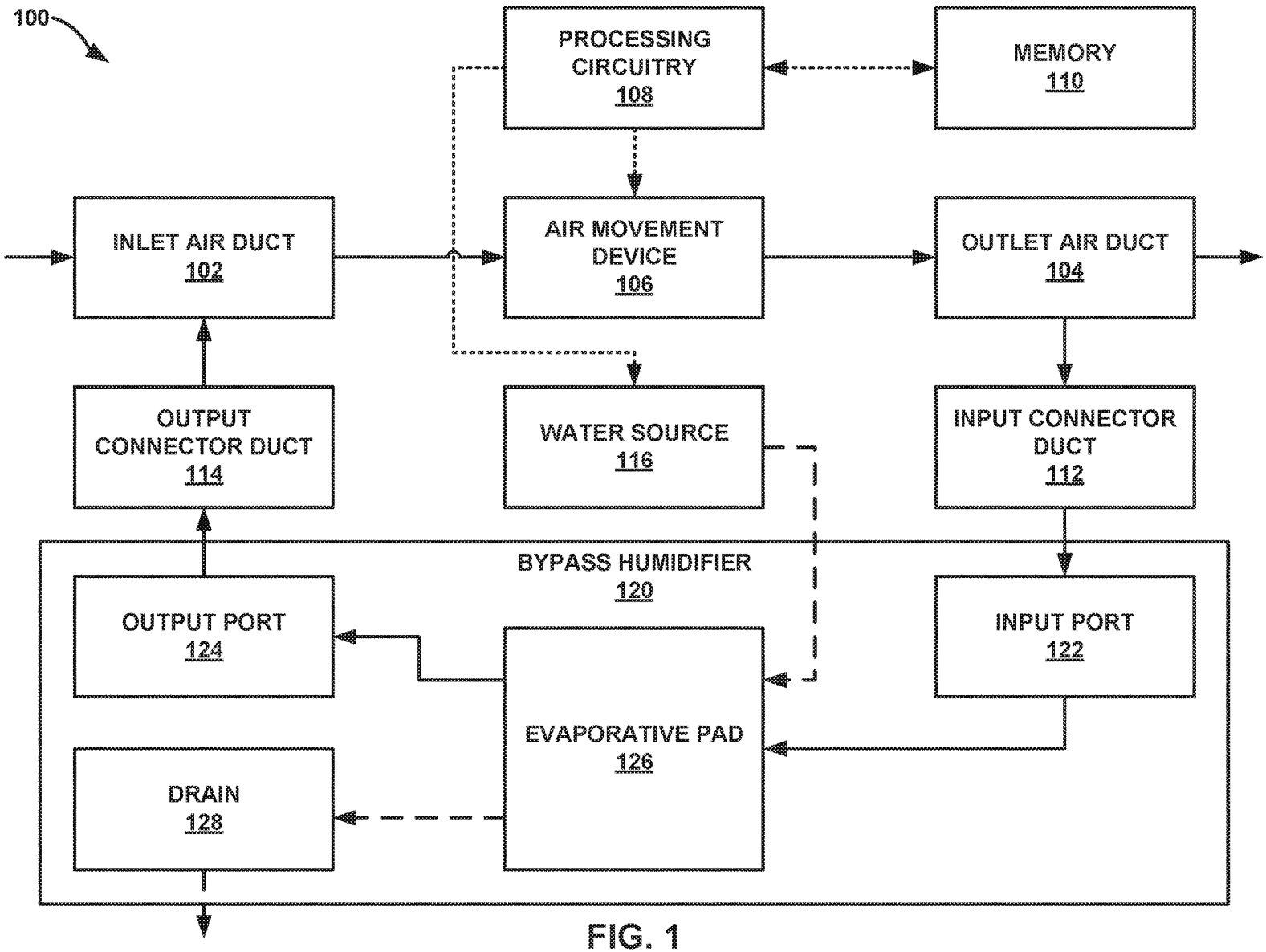
FIG. 1 is a block diagram illustrating a system for adding moisture to an air stream of a heating, ventilation and air conditioning (HVAC) system configured to regulate one or more parameters of a space within a building, in accordance with one or more techniques of this disclosure.

FIG. 1 is a block diagram illustrating a system 100 for adding moisture to an HVAC system configured to regulate one or more parameters of a space within a building, in accordance with one or more techniques of this disclosure. As seen in FIG. 1, system 100 includes inlet air duct 102, outlet air duct 104, air movement device 106, processing circuitry 108, memory 110, input connector duct 112, output connector duct 114, water source 116, and bypass humidifier 120. Bypass humidifier 120 includes input port 122, output port 124, evaporative pad 126, and drain 128. In some cases, system 100 may be located within a building, within any one or more of a set of buildings, proximate to a building or a set of buildings, or any combination thereof.

Inlet air duct 102 and outlet air duct 104 (collectively, ducts 102, 104) may be a part of a duct system which carries an air stream throughout one or more rooms, wings, or regions of one or more buildings that are regulated by system 100. In some examples, ducts 102, 104, may include any one or combination of materials including aluminum sheet metal, plastic, steel sheet metal, other types of metals, or any combination thereof. The duct system including ducts 102, 104, in some cases, may form a circuit which cycles at least some of the air stream in a loop. In other cases, the duct system including ducts 102, 104 may form a line which carries the air stream from an ingress point to an egress point. The air stream carried by ducts 102, 104 may include an amount of moisture. Bypass humidifier 120 may supplement (e.g., add to) the amount of moisture within the air stream.

Air movement device 106 may cause the air stream to flow through the duct system from inlet air duct 102 to outlet air duct 104. In some examples, air movement device 106 may include any one or combination of an air handler, a blower, an air-handling fan, or another type of fan. In any case, air movement device 106 may establish an air pressure differential between inlet air duct 102 and outlet air duct 104, causing the air stream to flow through the duct system. For example, an air pressure within inlet air duct 102 may be greater than an air pressure within outlet air duct 104. In some examples, ducts 102, 104 may be connected to bypass humidifier 120 via input connector duct 112 and output connector duct 114. For example, input connector duct 112 may connect bypass humidifier 120 to outlet air duct 104 and output connector duct 114 may connect bypass humidifier 120 to inlet air duct 102. Air may flow through bypass humidifier 120 in order to add moisture to the air stream of the duct system including ducts 102, 104.

Processing circuitry 108, in some examples, may include one or more processors that are configured to implement functionality and/or process instructions for execution within system 100. For example, processing circuitry 108 may be capable of processing instructions stored in a memory, such as memory 110. Processing circuitry 108 may include, for example, microprocessors, digital signal processors (DSPs), application specific integrated circuits (ASICs), field-programmable gate arrays (FPGAs), or equivalent discrete or integrated logic circuitry, or a combination of any of the foregoing devices or circuitry. Accordingly, processing circuitry 108 may include any suitable structure, whether in hardware, software, firmware, or any combination thereof, to perform the functions ascribed herein to processing circuitry 108.

In some examples, memory 110 includes computer-readable instructions that, when executed by processing circuitry 108, cause system 100 and processing circuitry 108 to perform various functions attributed to system 100 and processing circuitry 108 herein. Memory 110 may include any volatile, non-volatile, magnetic, optical, or electrical media, such as a random access memory (RAM), read-only memory (ROM), non-volatile RAM (NVRAM), electrically-erasable programmable ROM (EEPROM), flash memory, or any other digital media. In some examples, memory 110 stores instructions that, when executed by processing circuitry 108, cause bypass humidifier 120 to add moisture to an air stream which flows through ducts 102, 104.

Bypass humidifier 120, in some cases, may represent a device that is configured to evaporate water in order to add moisture to air passing through an air path of bypass humidifier 120. In some examples, the air path of bypass humidifier 120 may extend from input port 122 connected to input connector duct 112 to output port 124 connected to output connector duct 114. The air path travels through evaporative pad 126. In this way, as air travels from input port 122 to output port 124 through evaporative pad 126, evaporative pad 126 adds moisture to the air flowing through the air path of bypass humidifier 120. At a conclusion of the air path of bypass humidifier 120, bypass humidifier 120 delivers air to inlet air duct 102 via output port 124. As such, bypass humidifier 120 adds moisture to the air stream flossing through ducts 102, 104, where at least some of the added moisture represents water that is evaporated by evaporative pad 126.

In some examples, bypass humidifier 120 includes evaporative pad support rails configured to hold evaporative pad 126 in a fixed position within a housing of bypass humidifier 120. Evaporative pad 126 may divide the housing of bypass humidifier 120 into an intake section and a discharge section. The air path of bypass humidifier 120 may direct air flow to the discharge section from the intake section and through evaporative pad 126. In some examples, the housing of bypass humidifier 120 includes a top housing and a bottom housing. A bottom portion of the top housing may be configured to fit with a top portion of the bottom housing such that the top housing and the bottom housing connect to form the full housing. In some examples, the top housing firms input port 122 and output port 124, and the bottom housing includes drain 128. Water may flow from water source 116 into bypass humidifier 120 via an aperture in the top housing, and the bypass humidifier 120 may deliver the water to a top end of evaporative pad 126. Evaporative pad 126 may evaporate at least a portion of the water as it flows down from the top end of evaporative pad 126 to a bottom end of evaporative pad 126.

Evaporative pad 126 might not evaporate all of the water delivered by water source 116. In some examples, bypass humidifier 120 outputs water not evaporated by evaporative pad 126 via drain 128 formed by a bottom end of the bottom housing of bypass humidifier 120. Since the housing of bypass humidifier 120 may include the top housing and the bottom housing which forms drain 128, bypass humidifier 120 may be more effective at preventing water leakage as compared with bypass humidifiers which do not include a bottom housing configured to drain non-evaporated water. In some examples, drain 128 may output water to a floor drain within the building or another system configured to output excess water from a building without causing water damage to the building. The top housing of bypass humidifier 120 may be configured to at least partially separate from the bottom housing of bypass humidifier 120 such that evaporative pad 126 and/or other objects may be inserted or removed from the housing of bypass humidifier 120.

In some examples, the air pressure differential between inlet air duct 102 and outlet air duct 104 causes air to flow through the air path of bypass humidifier 120, thus adding moisture to the air stream which flows through ducts 102, 104. For example, the air path of bypass humidifier 120 may form a humidifier circuit with inlet air duct 102, outlet air duct 104, and air movement device 106, where air flow through the humidifier circuit is driven by air movement device 106 just as air flow within the duct system of system 100 is driven by air movement device 106. Air flow through the humidifier circuit may add moisture to the air path which flows through the duct system of system 100.

In some examples, the input port 122 and the output port 124 (collectively, "ports 122, 124) may represent stadium-shaped apertures formed on a top surface of the top housing of bypass humidifier 120, but this is not required. Ports 122, 124 may be formed by any part of the top housing or the bottom housing of bypass humidifier 120. Ports 122, 124 may be of any shape. In some cases, it may be beneficial for ports 122, 124 to be stadium-shaped so that a thickness of bypass humidifier 120 is decreased as compared with humidifiers that have input/output ports that are not stadium-shaped (e.g., circular). This is because a stadium-shaped aperture which defines input port 122 or output port 124 may include a first dimension and a second dimension, the first dimension being greater than the second dimension. Input port 122 and output port 124 may be formed on a top of the top housing of bypass humidifier 120. The second dimension of ports 122, 124 may be parallel with a width dimension of the housing. In this way, it may be beneficial to decrease the second dimension of ports 122, 124 while maintaining a surface area of ports 122, 124 in order to decrease a width of bypass humidifier 120 as compared with a humidifier having input/output ports with greater dimensions aligned with a width of the respective humidifier. Stadium-shaped ports 122, 124 may be more beneficial for preserving surface area while decreasing width as compared with one or more other shapes.

Processing circuitry 108 may be configured to control an amount of moisture added to the air stream flowing through the duct system including ducts 102, 104 by bypass humidifier 120. For example, processing circuitry 108 may output a control signal to a valve (not illustrated in FIG. 1) of water source 116 in order to regulate an amount of water that evaporative pad 126 receives from water source 116. In some examples, processing circuitry 108 may increase an amount of moisture added to the air stream by increasing an amount of water that is delivered to evaporative pad 126 by water source 116. Additionally, or alternatively, processing circuitry 108 may decrease an amount of moisture added to the air stream by decreasing an amount of water that is delivered to evaporative pad 126 by water source 116. As described above, evaporative pad 126 may become saturated to the point that at least some excess water exits a bottom end of evaporative pad 126 into the bottom housing of bypass humidifier 120. The bottom housing of bypass humidifier 120 may be formed of a single part such that no creases exist in the bottom housing to allow leakage of excess water. Drain 128, which is formed in a bottom of the bottom housing, may be the only exit point for excess water.

Additionally, or alternatively, processing circuitry 108 may output a control signal in order to regulate one or more parameters corresponding to air movement device 106. For example, processing circuitry 108 may control a rate in which air movement device 106 moves the air stream through the duct system including ducts 102, 104. In examples where air movement device 106 is a fan, processing circuitry 108 may regulate a rotational velocity of the fan. In examples where air movement device 106 is a blower, processing circuitry 108 may regulate a power of the blower. Processing circuitry 108 may be configured to turn on or turn off air movement device 106.

Bypass humidifier 120 may be configured to be mounted on a surface, such as a vertical surface or a near-vertical surface. In some examples, bypass humidifier 120 may be mounted directly on a surface of inlet air duct 102, outlet air duct 104, air movement device 106, or any combination thereof, but this is not required. Bypass humidifier 120 may be mounted on any surface such that input connector duct 112 connects outlet air duct 104 to input port 122 and output connector duct 114 connects output port 124 to inlet air duct 102.

Figure 2:
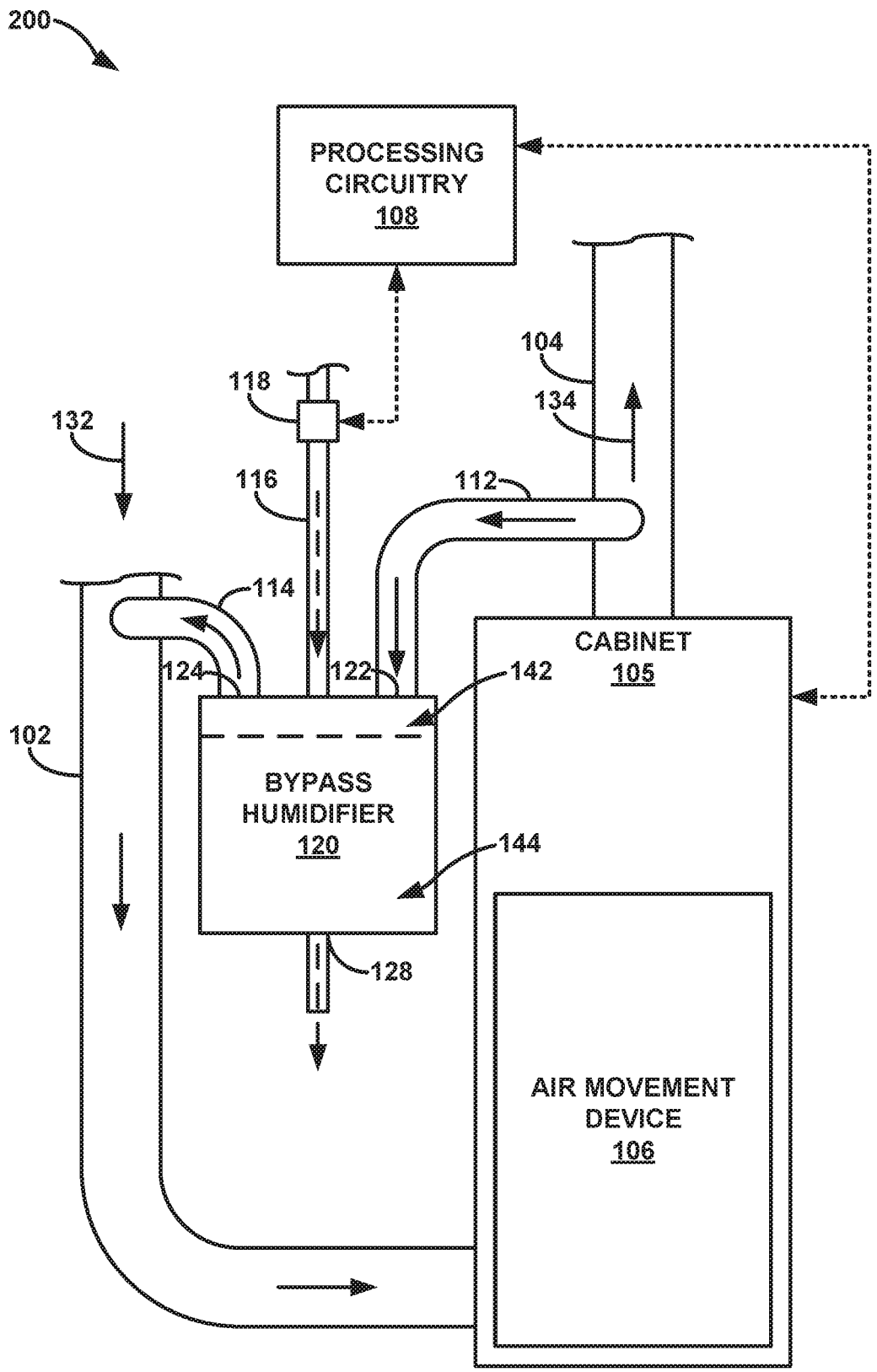
FIG. 2 is a conceptual diagram illustrating a system for adding, by a bypass humidifier, moisture to an HVAC system configured to regulate one or more parameters of a space within a building, in accordance with one or more techniques of this disclosure.

FIG. 2 is a conceptual diagram illustrating a system 200 for adding, by a bypass humidifier 120, moisture to an HVAC system configured to regulate one or more parameters of a space within a building, in accordance with one or more techniques of this disclosure. As seen in FIG. 2, system 200 includes inlet air duct 102, outlet air duct 104, air movement device 106, processing circuitry 108, input connector duct 112, output connector duct 114, water source 116, and bypass humidifier 120 of FIG. 1. Bypass humidifier 120 forms input port 122, output port 124, and drain 128 and bypass humidifier 120 includes top housing 142 and bottom housing 144. Top housing 142 may form input port 122 and output port 124 on a top end (not illustrated in FIG. 2) of top housing 142. Bottom housing 144 may form drain 128 on a bottom end (not illustrated in FIG. 2) of bottom housing 144. Additionally, system 200 includes cabinet 105 which holds air movement device 106, and system 200 includes water valve 118.

The conceptual diagram of FIG. 1 may use graphic symbols as a representation of the system. System 200 may represent a forced air HVAC system of an up-flow type, but any suitable forced air HVAC system 200 may be used (e.g., down-flow, horizontal-flow, lowboy, highboy, etc.). In example HVAC system 200, inlet air duct 102 delivers return air 132 from a conditioned air space to cabinet 105. Cabinet 105 may enclose air movement device 106 which includes an air handler, blower, or air-handling fan (not shown in FIG. 1), that when activated pulls air from a duct system via inlet air duct 102 and delivers outgoing air 134 to the duct system via outlet air duct 104. In this way, return air 132 and outgoing air 134 may represent an air stream that is driven by air movement device 106. Air movement device 106 may create an air pressure differential between inlet air duct 102 and outlet air duct 104 which causes return air 132 to flow towards cabinet 105 and causes outgoing air 134 to flow away from cabinet 105.

Cabinet 105 may include one or more components (not illustrated in FIG. 2) to help condition the return air 132 before supplying it to the duct system via the outlet air duct 104. For example, cabinet 105 may include one or more filters (not shown in FIG. 1) for removing particulates and/or other contaminants from the return air 132. In some examples, cabinet 105 may include a heat exchanger, such as a gas burner, an electric resistance heating element, an evaporator and/or condenser coil, and/or any other type of heat exchanger (not illustrated in FIG. 1).

System 200 is may include bypass humidifier 120. Bypass humidifier 120 includes a housing that is secured to a surface (e.g., a vertical or near vertical surface). In some examples, the housing of bypass humidifier 120 includes a top housing 142 and a bottom housing 144. The housing of bypass humidifier 120 defines at least part of an air path of system 200. Part of the air path is defined by a first hole (not illustrated in FIG. 1) cut through a wall of outlet air duct 104 and a second hole (not illustrated in FIG. 1) cut through a wall of inlet air duct 102. A backplane of the housing of bypass humidifier 120 may be mounted to a surface in order to secure bypass humidifier 120 proximate to inlet air duct 102 and outlet air duct 104 such that input connector duct 112 can connect the first hole to input port 122 of bypass humidifier 120 and output connector duct 114 can connect output port 124 of bypass humidifier 120 to the second hole.

In this disclosure, the term "air path" is used to refer to a path in which air moves through bypass humidifier 120 between outlet air duct 104 and inlet air duct 102. In some examples, the air path begins at the first hole in the outlet air duct 104, extends through the input connector duct 112 to input port 122, extends through bypass humidifier 120 to output port 124, and finally extends through output connector duct 114 to the second hole in inlet air duct 102. In this disclosure, the term "air stream" is used to refer to a route in which air moves though the duct system including ducts 102, 104 and cabinet 105, not including the "air path." Thus, the "air stream" includes air moving through inlet air duct 102 (e.g., return air 132), through components of cabinet 105 and out of outlet air duct 104 (e.g., outgoing air 134).

In the example of FIG. 2, the air path through bypass humidifier 120 removes air from the air stream via the first hole in outlet air duct 104 which is connected to input connector duct 112, and returns humidified air to the air stream via output connector duct 114. In some examples, an amount of moisture in the humidified air delivered to the air stream via output connector duct 114 may be greater than an amount of moisture removed from the air stream via input connector duct 112. More specifically, bypass humidifier 120 may add moisture to air which flows through bypass humidifier 120 along the air path. Bypass humidifier 120 may be configured to hold an evaporative pad (e.g., evaporative pad 126 of FIG. 1) which is supplied water by water source 116. As seen in FIG. 2, water source 116 may represent a water pipe which is connected to a municipal water supply, a well, or another kind water supply. Water source 116 may supply water to the evaporative pad through an aperture formed in top housing 142 or an aperture formed in bottom housing 144, and the evaporative pad may evaporate the water such that air moving through the air path to inlet air duct 102 carries moisture to the air stream flowing through ducts 102, 104.

When flowing, water is provided to the evaporative pad (e.g., evaporative pad 126 of FIG. 1) within bypass humidifier 120, to moisten the evaporative pad. In the example of FIG. 2, water flows from a top of the evaporative pad to a bottom of the evaporative pad (e.g., the direction of gravity). Bypass humidifier 120 is configured such that air flowing through the air path across bypass humidifier 120 flows through the moistened evaporative pad, which is held by the housing of bypass humidifier 120. The flow of air in the air path is configured to evaporate some of the moisture from the evaporative pad. Evaporation of at least some of the water from the moistened evaporative pad may therefore impart humidity to the air flowing through the air path. In some cases, not all of the water provided to the evaporative pad by water source 116 may be evaporated by the air flowing through the air path. Some of the water provided to the evaporative pad may reach the bottom of the evaporative pad. Excess water may be collected by bottom housing 144 of bypass humidifier 120 and expelled via drain 128.

The top housing 142 of bypass humidifier 120, as shown in FIG. 1, forms input port 122 and output port 124. An output connector duct 114 is coupled between the output port 124 of top housing 142 and inlet air duct 102 and an input connector duct 112 is coupled between the input port 122 of top housing 142 and outlet air duct 104. When air movement device 106 is activated, air may flow along the air path through bypass humidifier 120 from input connector duct 112, through bypass humidifier 120 to pick up moisture, through output connector duct 114 to inlet air duct 102, driven at least in part by a pressure difference between outlet air duct 104 and inlet air duct 102 that is created by air movement device 106. For example, the pressure difference between the ducts 102, 104 may be generated by an air-handling fan, a blower, or other component included in air movement device 106. In some examples, a damper (not illustrated in FIG. 2) may be included in one or both of input connector duct 112 and output connector duct 114 and may be controlled to selectively block or unblock (e.g., not allow or allow) a flow of air along the air path through bypass humidifier 120.

System 200 may include processing circuitry 108. Processing circuitry 108 may be configured to control one or more components of System 200. In some examples, processing circuitry 108 may control valve 118 in order to regulate the flow of water to the evaporative pad held by bypass humidifier 120. Additionally, or alternatively, processing circuitry 108 may control a damper on input connector duct 112 and/or a damper on output connector duct 114 in order to control a flow of air through the air path across bypass humidifier 120. Processing circuitry 108 may control other components (e.g., an air handler, a blower, or an air-handling fan) included in cabinet 105 in order to regulate the flow of return air 132 and/or outgoing air 134.

Examples of processing circuitry 108 include any one or combination of a microcontroller (MCU) (e.g., a computer on a single integrated circuit containing a processor core, memory, and programmable input/output peripherals), a microprocessor (μP) (e.g., a central processing unit (CPU) on a single integrated circuit (IC)), a controller, a digital signal processor (DSP), an application specific integrated circuit (ASIC), a field-programmable gate array (FPGA), a system on chip (SoC) or equivalent discrete or integrated logic circuitry. A processor may include integrated circuitry (e.g., integrated processing circuitry), and the integrated processing circuitry may be realized as fixed hardware processing circuitry, programmable processing circuitry and/or a combination of both fixed and programmable processing circuitry. Accordingly, the terms "processing circuitry," "processor," or "controller," as used herein, may refer to any one or more of the foregoing structures or any other structure operable to perform techniques described herein.

Figure 3A:
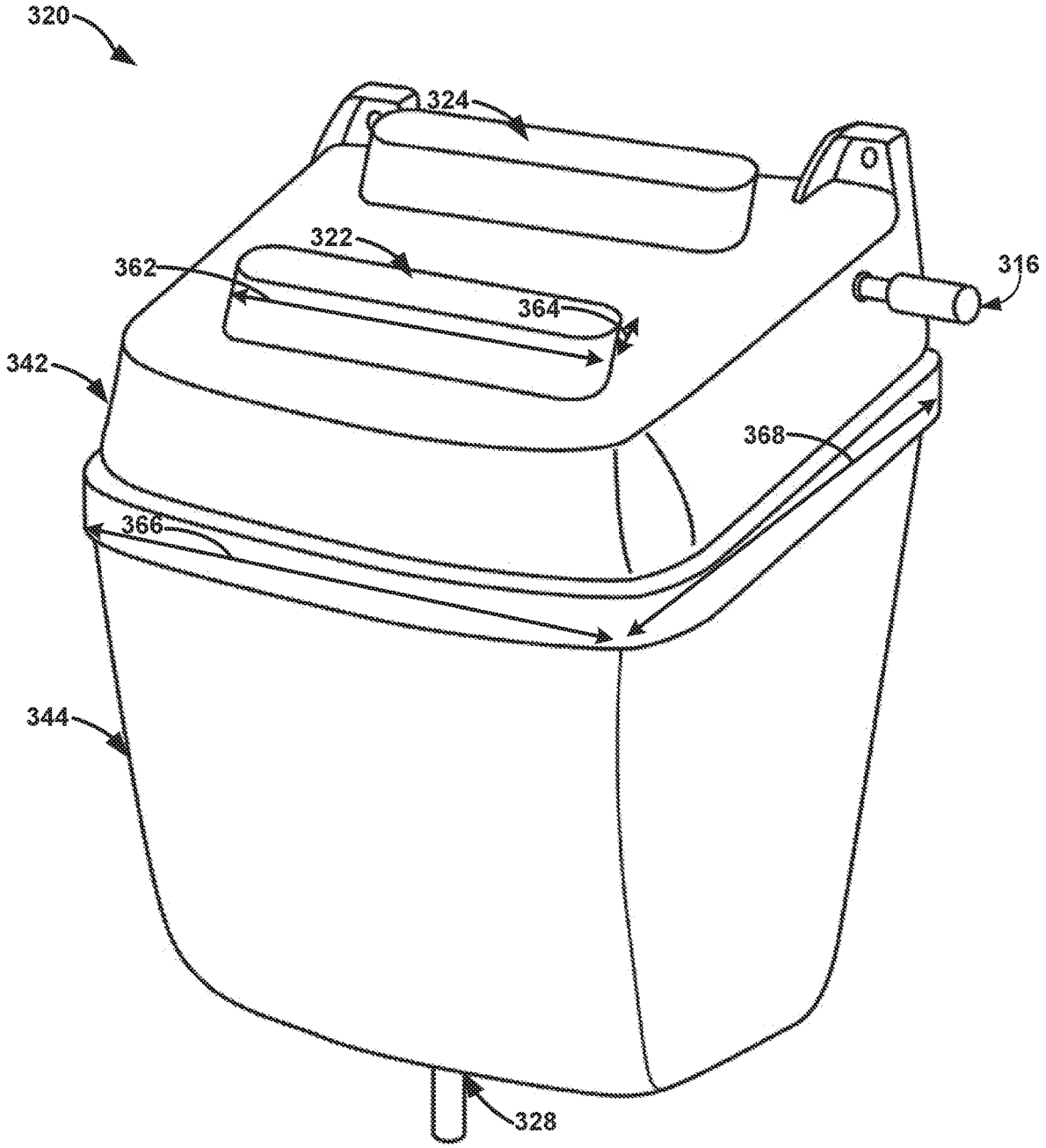
FIG. 3A is a conceptual diagram illustrating a perspective view of a bypass humidifier, in accordance with one or more techniques of this disclosure.

FIG. 3A is a conceptual diagram illustrating a perspective view of a bypass humidifier 320, in accordance with one or more techniques of this disclosure. Bypass humidifier 320 includes water source 316, input port 322, output port 324, drain 328, top housing 342, and bottom housing 344. Bypass humidifier 320 may be an example of bypass humidifier 120 of FIG. 1. Water source 316 may be an example of water source 116 of FIG. 1. Input port 322 may be an example of input port 122 of FIG. 1. Output port 324 may be an example of output port 124 of FIG. 1. Drain 328 may be an example of drain 128 of FIG. 1. Top housing 342 may be an example of top housing 142 of FIG. 2. Bottom housing 344 may be an example of bottom housing 144 of FIG. 2. The configuration of bypass humidifier 320 might not represent the only humidifier configuration described herein.

As seen in FIG. 3A, input port 322 and output port 324 may be formed as apertures in top housing 342. As such, an input connector duct (e.g., input connector duct 112 of FIG. 1) may be connected to input port 322 and an output connector duct (e.g., output connector duct 114 of FIG. 1) may be connected to output port 324 such that air may flow through an air path across bypass humidifier 320. For example, air may flow from the input connector duct to input port 322, through bypass humidifier 320, exit bypass humidifier 320 via output port 324, and continue through the output connector duct. In some examples, top housing 342 and bottom housing 344 are configured to fit together such that bypass humidifier 320 can hold an evaporative pad (e.g., evaporative pad 126) of FIG. 1. Additionally, or alternatively, top housing 342 may be configured to at least partially separate from bottom housing 344 such that the evaporative pad may be placed in or removed from bypass humidifier 320. For example, one or more hinges (not illustrated in FIG. 3A) or other connector devices may connect top housing 342 to bottom housing 344 such that top housing 342 may rotate with respect to bottom housing 344 about an axis which passes through the one or more hinges or other connector devices. It is not required for top housing 342 to be connected to bottom housing 344 using a hinge. In some cases, top housing 342 may be configured to completely separate from bottom housing 344 in order to place and/or replace an evaporative pad.

In some examples, input port 322 and output port 324 (collectively, "ports 322, 324") may represent stadium-shaped apertures in top housing 342, but this is not required. Ports 322, 324 may be any one or combination of oval-shaped, circular-shaped, or ellipse-shaped. In some examples, ports 322, 324 may each include a long dimension and a short dimension. For example, input port 322 includes a first dimension 362 and a second dimension 364. In some examples, first dimension 362 may be within a range from 3 inches (in) to 9 in. In one example, first dimension 362 may be 6 inches. In some examples, second dimension 364 may be within a range from 0.5 in to 6 in.

In some examples, it may be beneficial for input port 322 and output port 324 to form a stadium shape, an oval, an ellipse, or another elongated shape such that a long dimension of the respective port is greater than the short dimension of the respective port. For example, bypass humidifier 320 may include a width dimension 366 and a depth dimension 368, where the width dimension 366 is parallel to the first dimension 362 and the depth dimension 368 is parallel to the second dimension 364. It may be beneficial for depth dimension 368 to be shorter than a depth dimension of a humidifier which does not have elongated input/output ports (e.g., the first dimension is not longer than the short dimension). A first humidifier with a first depth dimension may be easier to mount on a surface than a second humidifier having a second depth dimension greater than the first depth dimension, since the humidifier may need to be mounted between two vertical surfaces with a limited amount of clearance separating them. In some examples, width dimension 366 may be within a range from 12 in to 30 in. In some examples, depth dimension 368 may be within a range from 6 in to 24 in.

As seen in FIG. 3A, bypass humidifier 320 may include bottom housing 344, which forms a reservoir to collect excess water delivered by water source 316. In some examples, bottom housing 344 may be formed of a single piece of molded plastic. In some examples, the reservoir formed by bottom housing 344 may expel the excess water via drain 328, which leads to a location (e, g., a floor drain) for disposing the excess water without causing damage to a building in which bypass humidifier 320 is located. Although input port 322 is illustrated as being closer to a front side of bypass humidifier 320 than output port 324, this is not required. In some examples, output port 324 may be closer to the front side than input port 322. In some examples, input port 322 and output port 322 may be aligned side-by-side along the width dimension 366 of bypass humidifier 320.

Figure 3B:
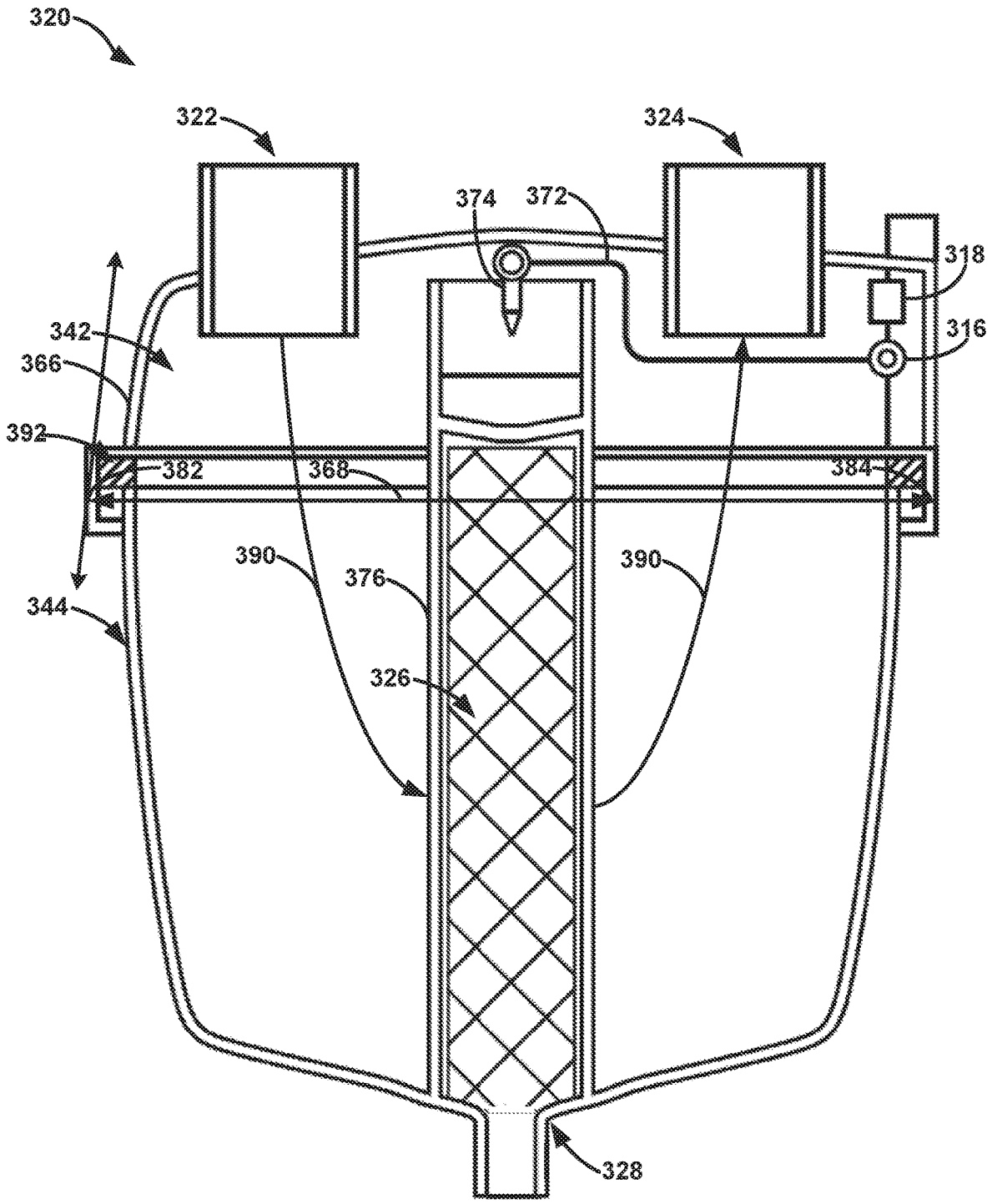
FIG. 3B is a conceptual diagram illustrating a cross-sectional view of the bypass humidifier of FIG. 3A, in accordance with one or more techniques of this disclosure.

FIG. 3B is a conceptual diagram illustrating a cross-sectional view of bypass humidifier 320, in accordance with one or more techniques of this disclosure. Bypass humidifier 320 includes water source 316, valve 318, input port 322, output port 324, drain 328, top housing 342, bottom housing 344, water distributor line 372, water nozzle, 374, and evaporative pad rails 376. In some examples, evaporative pad rails 376, placed within bottom housing 344, are configured to hold an evaporative pad 326. Valve 318 may be an example of valve 118 of FIG. 1. Evaporative pad 326 may be an example of evaporative pad 126 of FIG. 1. FIG. 3B illustrates a cross-section of bypass humidifier 320 across the depth dimension 368. Gasket 392 may be located where a surface of top housing 342 connects with a surface of bottom housing 344, but this is not required. In some examples, gasket 392 is not included in humidifier 320.

Depth dimension 368 may extend from a front end 382 of bypass humidifier 320 to a back end 384 of bypass humidifier 320. In some examples, a back side of bypass humidifier 320 may be secured to a surface (e.g., a wall, a duct, and/or another surface), the back side corresponding to back end 384. As seen in FIG. 3B, evaporative pad rails 376 may be configured to hold evaporative pad 326 within bottom housing 344 such that evaporative pad 326 is located underneath water nozzle 374. In some examples, water source 316 may deliver water to water nozzle 374 via water distributor line 372. Water nozzle 374 may deliver water to a top of evaporative pad 326, and the water may flow in the direction of gravity through evaporative pad 326 to a bottom end of evaporative pad 326 proximate to drain 328. Air may travel through an air path 390 from input port 322 to output port 324 across evaporative pad 326. As the air travels across evaporative pad 326, water may evaporate off evaporative pad 326, thus adding moisture to the air travelling through air path 390. Subsequently, the air may exit through output port 324 and join the air stream travelling through a duct system, adding moisture to the air stream. Excess water supplied by water nozzle 374 that is not evaporated may exit bypass humidifier 320 via drain 328.

Figure 4A:
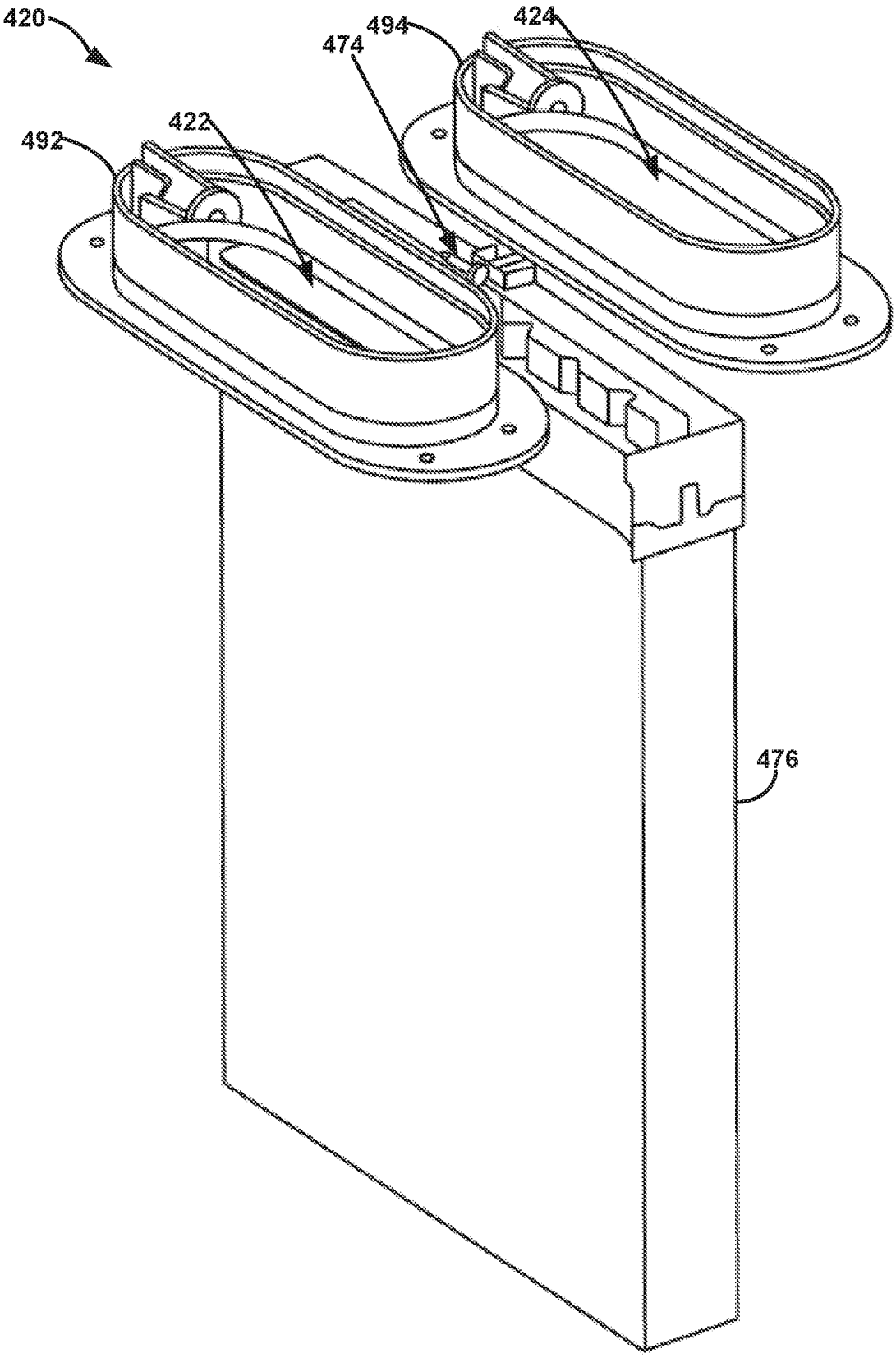
FIG. 4A is a conceptual diagram illustrating an input port, an output port, and an evaporative pad configured to be held by a bypass humidifier, in accordance with one or more techniques of this disclosure.

FIG. 4A is a conceptual diagram illustrating an input port 422, an output port 424, and an evaporative pad 476 configured to be held by a bypass humidifier 420, in accordance with one or more techniques of this disclosure. In some examples, input port 422 may be formed by an input flange 492 and output port 424 may be formed by an output flange 494. Input flange 492 and output flange 494 may be a part of a top housing (not illustrated by FIG. 4A) of bypass humidifier 420. Additionally, bypass humidifier 420 may include water nozzle 474 positioned at a top of evaporative pad 476. Although the top housing of bypass humidifier 420 is not illustrated in FIG. 4A, input flange 492, output flange 494, and nozzle 474 may be configured to fit with the top housing such that air may flow across evaporative pad 476, evaporating water delivered to evaporative pad 476 by nozzle 474. Input flange 492 may be configured to connect to an input connector duct (e.g., input connector duct 112 of FIG. 1) and output flange 494 may be configured to connect to an output connector duct (e.g., output connector duct 114). The input connector duct and the output connector duct include flex ducts, hard ducts, and/or other kinds of ducts.

Figure 4B:
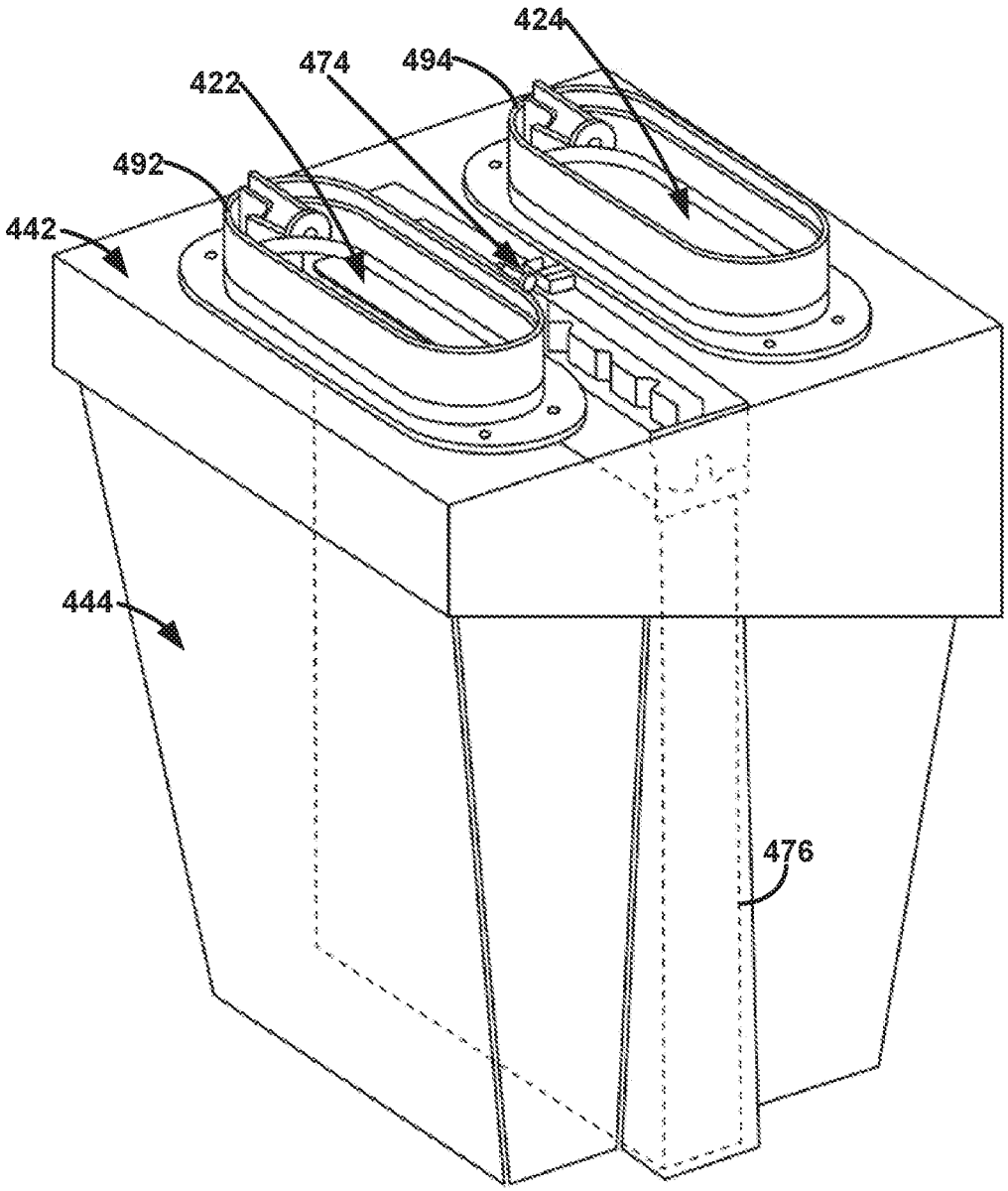
FIG. 4B is a conceptual diagram illustrating an input port, an output port, and an evaporative pad configured to be held by the bypass humidifier of FIG. 4A including a top housing and a bottom housing, in accordance with one or more techniques of this disclosure.

FIG. 4B is a conceptual diagram illustrating an input port 422, an output port 424, and an evaporative pad 476 configured to be held by a bypass humidifier 420 including a top housing 442 and a bottom housing 444, in accordance with one or more techniques of this disclosure. The bypass humidifier 420 illustrated by FIG. 4B may be substantially the same as the bypass humidifier 420 illustrated by FIG. 4A, except that the bypass humidifier 420 illustrated by FIG. 4B includes top housing 442 and bottom housing 444. In some examples, bottom housing 444 may be shaped such that evaporative pad 476 fits within bottom housing 444. As seen in FIG. 4B, an outer wall of bottom housing 444 may be shaped such that a "slot" may fit evaporative pad 476. Bypass humidifier 420 may perform any one or more of the techniques as described with respect to bypass humidifier 120 of FIGS. 1-2 and/or bypass humidifier 320 of FIGS. 3A-3B.

Figure 5:
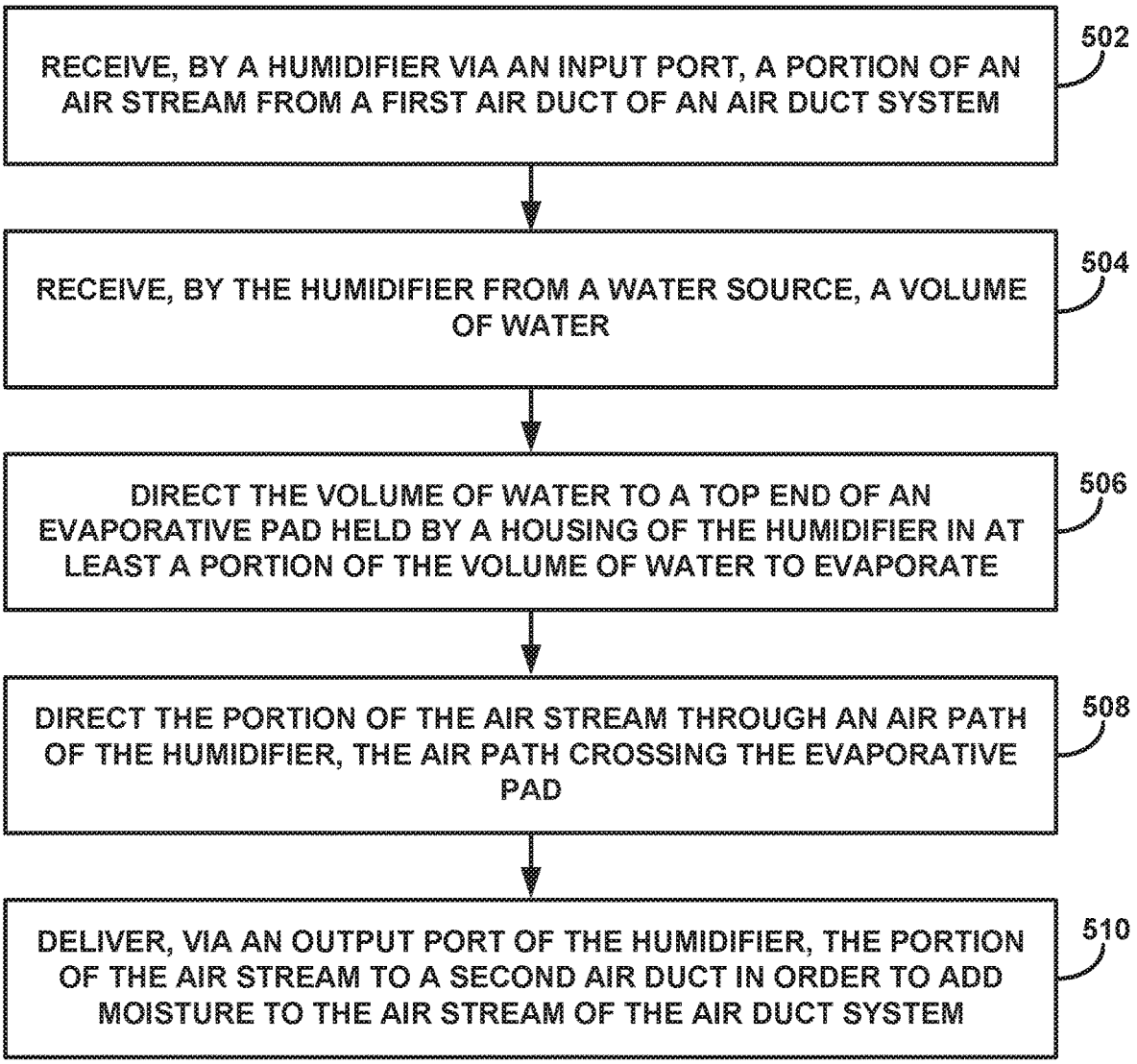
FIG. 5 is a flow diagram illustrating an example process for adding moisture to an air stream of a duct system using a bypass humidifier, in accordance with one or more techniques of this disclosure.

FIG. 5 is a flow diagram illustrating an example process for adding moisture to an air stream of a duct system using a bypass humidifier, in accordance with one or more techniques of this disclosure. For convenience, FIG. 5 is described with respect to system 100 of FIG. 1 and system 200 of FIG. 2. However, the techniques of FIG. 5 may be performed by different components of system 100 and system 200 or by additional or alternative devices.

Bypass humidifier 120 is configured to receive a portion of an air stream from a first air duct of an air duct system (502). In some examples, the first air duct may represent outlet air duct 104 of FIG. 1. Bypass humidifier 120 may receive the portion of the air stream via input connector duct 112, which joins outlet air duct 104 to input port 122. In some cases, an air path may form across bypass humidifier 120 such that air travels from the first air duct to a second air duct of the air duct system through bypass humidifier 120. Bypass humidifier 120 receives a volume of water from water source 116 (504). In some examples, bypass humidifier may include a water nozzle which is located at a top of evaporative pad 126. Bypass humidifier 120 may direct the volume of water to the top of evaporative pad 126 held by a housing of bypass humidifier 120 in order to cause at least a portion of the volume of water delivered by water source 116 to evaporate (506).

In some examples, the volume of water delivered by the water source 116 may flow from the top of evaporative pad 126 to a bottom of the evaporative pad 126 in the direction of gravity. The housing of bypass humidifier 120 may direct the portion of the air stream received by bypass humidifier 120 across evaporative pad 126 (508) as the volume of water travels from the top of evaporative pad 126 to the bottom of evaporative pad 126. In some examples, the flow of air across evaporative pad 126 may cause at least some of the volume of water delivered by water source 116 to evaporate, thus adding moisture to the air flowing through bypass humidifier 120. Subsequently, bypass humidifier 120 may deliver, via output port 124, the portion of the air stream received from the first duct to a second air duct in order to add moisture to the air stream of the air duct system (510). In some examples, excess water delivered by water source 116 and not evaporated off evaporative pad 126 may exit a housing of bypass humidifier 120 via a drain.

In one or more examples, the systems described herein may utilize hardware, software, firmware, or any combination thereof for achieving the functions described. Those functions implemented in software may be stored on or transmitted over, as one or more instructions or code, a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol. In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure.

Instructions may be executed by one or more processors within the accelerometer or communicatively coupled to the accelerometer. The one or more processors may, for example, include one or more DSPs, general purpose microprocessors, application specific integrated circuits ASICs, FPGAs, or other equivalent integrated or discrete logic circuitry. Accordingly, the term "processor," as used herein may refer to any of the foregoing structure or any other structure suitable for implementation of the techniques described herein. In addition, in some respects, the functionality described herein may be provided within dedicated hardware and/or software modules configured for performing the techniques described herein. Also, the techniques could be fully implemented in one or more circuits or logic elements.

The techniques of this disclosure may be implemented in a wide variety of devices or apparatuses that include integrated circuits (ICs) or sets of ICs (e.g., chip sets). Various components, modules, or units are described in this disclosure to emphasize functional aspects of devices configured to perform the disclosed techniques, but do not necessarily require realization by different hardware units. Rather, various units may be combined or provided by a collection of interoperative hardware units, including one or more processors as described above, in conjunction with suitable software and/or firmware.

Various examples of the disclosure have been described. These and other examples are within the scope of the following claims.

What is claimed is:

1. A device configured to add moisture to an air stream of a heating, ventilation, and air conditioning (HVAC) system configured to regulate one or more parameters of a space within a building, wherein the device comprises:

a housing that defines at least part of an air path, wherein the air path is configured to receive an air stream of the HVAC system, carry the moisture to the air stream of the HVAC system, and carry the moisture to the space within the building, wherein the housing comprises:

a bottom housing comprising:

evaporative pad support rails configured to hold an evaporative pad in a fixed position such that the evaporative pad divides the bottom housing into an intake section and a discharge section, wherein the air path is constrained to direct air flow to the discharge section from the intake section and through the evaporative pad;

a top housing configured to be attached to the bottom housing, wherein the top housing comprises:

an intake flange defining an intake port, wherein the intake port is configured to:

mechanically connect to a first air duct;

receive a portion of the air stream from the first air duct; and direct the portion of the air stream to the air path via the intake section of the bottom housing;

a discharge flange defining a discharge port, wherein the discharge port is configured to:

mechanically connect to a second air duct;

receive the portion of the air stream from the evaporative pad; and direct the portion of the air stream to the second air duct and the space within the building, wherein a difference in pressure between the first air duct and the second air duct causes air to flow through the air path from the first air duct to the second air duct; and a water distributor support configured to position a water distributor above the evaporative pad, wherein the water distributor is configured to deliver water to a top input of the evaporative pad through an aperture in the top housing.

2. The device of claim 1, wherein the water distributor is configured to deliver water to the top input of the evaporative pad, causing the water to travel through the evaporative pad from the top input of the evaporative pad to a bottom output of the evaporative pad and causing the evaporative pad to evaporate a portion of the water delivered to the top input of the evaporative pad.

3. The device of claim 2, wherein the portion of the air stream received from the evaporative pad by the discharge port includes at least a portion of the water evaporated by the evaporative pad, and by directing the portion of the air stream to the second air duct via the discharge port, the discharge port is configured to contribute to a humidity of the space within the building.

4. The device of claim 3, wherein the water distributor is configured to increase an amount of water delivered to the top input of the evaporative pad in order to increase the humidity of the space within the building.

5. The device of claim 3, wherein the water distributor is configured to decrease an amount of water delivered to the top input of the evaporative pad in order to decrease the humidity of the space within the building.

6. The device of claim 2, wherein the bottom housing further comprises a drain located on a bottom side of the bottom housing, wherein the bottom housing is configured to remove, via the drain, at least a portion of the water output from the bottom output of the evaporative pad.

7. The device of claim 1, wherein the top housing is configured to be mounted on a vertical surface separate from the HVAC system.

8. The device of claim 7, wherein the vertical surface comprises a wall of the building.

9. The device of claim 1, wherein the bottom housing is configured to be mounted on a vertical surface separate from the HVAC system.

10. The device of claim 1, wherein the intake port is configured to receive the portion of the air stream from a first side of an airflow device located within an air duct system including the first air duct and the second air duct, wherein the discharge port is configured to direct the portion of the air stream to a second side of the airflow device in response to the airflow device causing air to move through the duct system across the airflow device from the first side of the airflow device to the second side of the airflow device.

11. The device of claim 1, wherein the bottom housing is formed as a single piece of material.

12. A method for adding moisture to an air stream of a heating, ventilation and air conditioning (HVAC) system configured to regulate one or more parameters of a space within a building, wherein the method comprises:

carrying, by an air path defined by a housing of a device, moisture to an air stream of the HVAC system and into the space within the building;

holding, by a bottom housing of the housing of the device, an evaporative pad in a fixed position such that the evaporative pad divides the bottom housing into an intake section and a discharge section, wherein the air path is constrained to direct air flow to the discharge section from the intake section and through the evaporative pad, and wherein the bottom housing is formed as a single unit;

attaching a top housing to the bottom housing;

receiving a portion of the air stream from a first air duct by an intake port defined by an intake flange, wherein the intake port is configured to mechanically connect to the first air duct;

directing the portion of the air stream to the air path via the intake section of the bottom housing;

receiving the portion of the air stream from the evaporative pad by a discharge port defined by a discharge flange, wherein the discharge port is configured to mechanically connect to a second air duct, wherein a difference in pressure between the first air duct and the second air duct causes air to flow through the air path from the first air duct to the second air duct; and directing the portion of the air stream to the second air duct and the space within the building, wherein the device includes a water distributor support configured to position a water distributor above the evaporative pad, wherein the water distributor is configured to deliver water to a top input of the evaporative pad through an aperture in the top housing.

13. The method of claim 12, wherein the method further comprises delivering, by the water distributor, water to the top input of the evaporative pad, causing the water to travel through the evaporative pad from the top input of the evaporative pad to a bottom output of the evaporative pad and causing the evaporative pad to evaporate a portion of the water delivered to the top input of the evaporative pad.

14. The method of claim 13, wherein the portion of the air stream received from the evaporative pad by the discharge port includes at least a portion of the water evaporated by the evaporative pad, and wherein by directing the portion of the air stream to the second air duct via the discharge port, the method further comprises contributing to a humidity of the space within the building by the discharge port.

15. The method of claim 14, wherein the method further comprises increasing, by the water distributor, an amount of water delivered to the top input of the evaporative pad in order to increase the humidity of the space within the building.

16. The method of claim 14, wherein the method further comprises decreasing an amount of water delivered to the top input of the evaporative pad in order to decrease the humidity of the space within the building.

17. The method of claim 13, further comprising removing, via a drain located on a bottom side of the bottom housing, at least a portion of the water output from the bottom output of the evaporative pad.

18. The method of claim 12, further comprising mounting the top housing of the device on a vertical surface separate from the HVAC system.

19. The method of claim 12, further comprising mounting the device on a vertical surface separate from the HVAC system.

20. The method of claim 12, wherein the method further comprises:

receiving, by the intake port, the portion of the air stream from a first side of an airflow device located within an air duct system including the first air duct and the second air duct; and directing, by the discharge port, the portion of the air stream to a second side of the airflow device in response to the airflow device causing air to move through the duct system across the airflow device from the first side of the airflow device to the second side of the airflow device.

21. A system configured to add moisture to an air stream of a heating, ventilation and air conditioning (HVAC) system configured to regulate one or more parameters of a space within a building, wherein the system comprises:

an evaporative pad;

a housing that defines at least part of an air path, wherein the air path is configured to receive the air stream of the HVAC system, carry the moisture to the air stream of the HVAC system, and carry the moisture to the space within the building, wherein the housing comprises:

a bottom housing formed as a single unit, wherein the bottom housing comprises:

evaporative pad support rails configured to hold the evaporative pad in a fixed position such that the evaporative pad divides the bottom housing into an intake section and a discharge section, wherein the air path is constrained to direct air flow to the discharge section from the intake section and through the evaporative pad;

a top housing configured to be attached to the bottom housing, wherein the top housing comprises:

an intake flange defining an intake port, wherein the intake port is configured to:

mechanically connect to a first air duct;

receive a portion of the air stream from the first air duct; and direct the portion of the air stream to the air path via the intake section of the bottom housing;

a discharge flange defining a discharge port, wherein the discharge port is configured to:

mechanically connect to a second air duct;

receive the portion of the air stream from the evaporative pad; and direct the portion of the air stream to the second air duct and the space within the building, wherein a difference in pressure between the first air duct and the second air duct causes air to flow through the air path from the first air duct to the second air duct; and a water distributor support configured to position a water distributor above the evaporative pad, wherein the water distributor is configured to deliver water to a top input of the evaporative pad through an aperture in the top housing.

* * * * *